US011329380B2

(12) United States Patent
Coupez

(10) Patent No.: US 11,329,380 B2
(45) Date of Patent: May 10, 2022

(54) CONFIGURABLE MULTIBAND WIRE ANTENNA ARRANGEMENT AND DESIGN METHOD THEREOF

(71) Applicant: INSTITUT MINES TELECOM—IMT ATLANTIQUE—BRETAGNE—PAYS DE LA LOIRE, Brest (FR)

(72) Inventor: Jean-Philippe Coupez, Brest (FR)

(73) Assignee: INSTITUT MINES TELECOM—IMT ATLANTIQUE—BRETAGNE—PAYS DE LA LOIRE, Brest (FR)

( * ) Notice: Subject to any disclaimer, the term of this patent is extended or adjusted under 35 U.S.C. 154(b) by 57 days.

(21) Appl. No.: 16/768,491

(22) PCT Filed: Dec. 17, 2018

(86) PCT No.: PCT/EP2018/085197
§ 371 (c)(1),
(2) Date: May 29, 2020

(87) PCT Pub. No.: WO2019/121512
PCT Pub. Date: Jun. 27, 2019

(65) Prior Publication Data

US 2020/0388920 A1 Dec. 10, 2020

(30) Foreign Application Priority Data

Dec. 19, 2017 (EP) ..... 17306823

(51) Int. Cl.
*H01Q 5/35* (2015.01)
*H01Q 5/321* (2015.01)
(Continued)

(52) U.S. Cl.
CPC ..... *H01Q 5/321* (2015.01); *H01Q 1/14* (2013.01); *H01Q 1/36* (2013.01); *H01Q 5/357* (2015.01); *H01Q 9/42* (2013.01)

(58) Field of Classification Search
CPC ..... H01Q 1/14; H01Q 5/357; H01Q 5/321; H01Q 1/36; H01Q 9/42
See application file for complete search history.

(56) References Cited

U.S. PATENT DOCUMENTS 8,207,895 B2 * 6/2012 Wong ..... H01Q 9/0442 343/700 MS
2009/0015504 A1 1/2009 Tsai et al.
(Continued)

FOREIGN PATENT DOCUMENTS

WO 2001/22528 A1 3/2001
WO 2003/34544 A1 4/2003
(Continued)

OTHER PUBLICATIONS

European Search Report issued in European Patent Application No. 17 306 823.0-1205 dated Apr. 1, 2021.

*Primary Examiner* — Graham P Smith
(74) *Attorney, Agent, or Firm* — BakerHostetler

(57) ABSTRACT

An antenna arrangement includes a conductive element configured to resonate at and above a chosen electromagnetic radiation frequency corresponding to a fundamental resonant mode. The conductive element is folded to make coupling areas intended to shift one or more of the resonant frequencies of the higher resonant modes. Each coupling area is defined related to the set of resonant frequencies according to which the antenna is supposed to work, and is formed by positioning parts of the conductive element facing each other. The location, along the conductive element, of the parts of that conductive element intended to form a given coupling area as well as the length of these
(Continued)

parts and as the width of the gap between them when the coupling area is formed, are determined so as to provide a given increase or decrease of the resonant frequency of a given resonant mode of the conductive element.

15 Claims, 7 Drawing Sheets

(51) Int. Cl.

| | |
|---|---|
| ***H01Q 5/357*** | (2015.01) |
| ***H01Q 1/14*** | (2006.01) |
| ***H01Q 1/36*** | (2006.01) |
| ***H01Q 9/42*** | (2006.01) |

(56) References Cited

U.S. PATENT DOCUMENTS

| | | | |
|---|---|---|---|
| 2009/0256763 | A1 | 10/2009 | Chi et al. |
| 2010/0289709 | A1 | 11/2010 | Guan |
| 2011/0082523 | A1 | 4/2011 | Nghiem et al. |
| 2012/0306703 | A1 | 12/2012 | Komaki et al. |

FOREIGN PATENT DOCUMENTS

| | | | |
|---|---|---|---|
| WO | 2014/188747 | A1 | 11/2014 |
| WO | 2015/007746 | A1 | 1/2015 |

* cited by examiner

CONFIGURABLE MULTIBAND WIRE ANTENNA ARRANGEMENT AND DESIGN METHOD THEREOF

CROSS-REFERENCE TO RELATED APPLICATIONS

This application is a National Stage of International patent application PCT/EP2018/085197, filed on Dec. 17, 2018, which claims priority to foreign European patent application No. EP 17306823.0, filed on Dec. 19, 2017, the disclosures of which are incorporated by reference in their entirety.

FIELD OF THE INVENTION

The invention relates to antenna arrangements having a plurality of operating frequencies in the VHF, UHF, S, C, X, or higher frequency bands.

More particularly it relates to wire antennas such that those used in mobile communication equipments like smartphones, which can access to several kinds of communication links using different frequency bands.

BACKGROUND OF THE INVENTION

Terminals or smartphones on board aircraft, ship, trains, trucks, cars, or carried by pedestrians, need to be connected while on the move.

These devices need both short and (very) long range communication capabilities, for voice/data and high-throughput data, as well as a low power and optimised consumption, for instance to enable users to watch/listen to multimedia content (video or audio), or participate in interactive games.

Many kinds of objects on-board vehicles or located in manufacturing plants, offices, warehouses, storage facilities, department stores, hospitals, sporting venues, or in private homes, are connected to the Internet of Things ("IoT") world. By way of examples only: tags to locate and identify objects in an inventory or to keep people in or out of a restricted area; devices to monitor physical activity or health parameters of users; sensors to capture environmental parameters (concentration of pollutants; hygrometry; wind speed, etc.); actuators to remotely control and command all kinds of appliances; etc. . . . .

More generally, IoT encompasses any type of electronic device that could be part of a command, control, communication and intelligence system, the system being for instance programmed to capture/process signals/data, transmit the same to another electronic device, or a server, process the data using processing logic implementing artificial intelligence or knowledge based reasoning and return information or activate commands to be implemented by actuators.

Radiofrequency communications are more versatile than fixed-line communications for connecting these types of objects or platforms. As a result, radiofrequency transmitter/receiver (T/R) modules are yet, and will be, more and more pervasive in professional and consumer applications and a plurality of T/R modules are commonly implemented on the same device.

By way of example, a smartphone typically includes a cellular communications T/R module, a Wi-Fi™/Bluetooth™ T/R module, a receiver of satellite positioning signals (from a Global Navigation Satellite System or GNSS). Wi-Fi, Bluetooth and 3G or 4G cellular communications are operated in the 2.5 GHz frequency band (S-band)

whereas GNSS receivers typically operate in the 1.5 GHz frequency band (L-band) and Radio Frequency IDentification (RFID) tags operate in the 900 MHz frequency band (UHF) or lower. Near Field Communication (NFC) tags operate in the 13 MHz frequency band (HF) at a very short distance (about 10 cm).

Regarding most of these equipments, able to communicate, and that are usually small and mobile, it seems that a good compromise for "IoT" connections lies in VHF or UHF bands (30-300 MHz and 300 MHz to 3 GHz) to get sufficient available bandwidth and range, a good resilience to multipath reflections as well as a good energy consumption balance.

However, a problem to be solved for the design of T/R modules at these frequency bands is to have antennas which are compact enough to fit with the dimensions of a connected object. Indeed, a traditional omnidirectional antenna of a monopole type, adapted, for instance for VHF bands, has a length between 25 cm and 2.5 m ($\lambda/4$). An antenna of that size cannot obviously be housed, as such, in a compact connected object.

A solution to this problem of length is provided by PCT application published under no WO2015007746, which has the same inventor and is currently co-assigned to the applicant of this application. This application discloses an antenna arrangement of a bung type, where a plurality of antenna elements are combined so that the ratio between the largest dimension of the arrangement and the wavelength may be much lower than a tenth of a wavelength, even lower than a twentieth or, in some embodiments than a fiftieth of a wavelength. To achieve such a result, the antenna element which controls the fundamental mode of the antenna is wound up in a 3D form factor, such as, for example, a helicoid so that its outside dimensions are reduced relative to its length.

Most equipment mentioned above also need to be compatible with terminals which communicate using Wi-Fi™ or Bluetooth™ frequency bands and protocols. As a consequence, some stages of the T/R module have to be compatible with both the VHF and S bands; moreover, if a GNSS receiver is added, a T/R capacity in the L band is also needed. This means that the antenna arrangements of such devices should be able to communicate simultaneously or successively in different frequency bands. However, adding as many antennas as frequency bands is costly in terms of space, power consumption and materials. This creates another challenging problem for the design of the antenna.

Some solutions are disclosed for base station antennas by PCT applications published under no WO200122528 and WO200334544. But these solutions do not operate in the VHF bands and do not provide arrangements which would be compact enough for most of the IoT and smart devices in these bands.

SUMMARY OF THE INVENTION

A purpose of the invention is to propose an antenna arrangement which can be designed and tuned in a simple manner to transmit/receive (T/R) radiofrequency signals at a plurality of frequencies, notably in the microwave or VHF/UHF domains, with an optimal compactness.

The invention advantageously fulfils this need by providing, according to a first aspect, an antenna monopole wire element tuned to a lower frequency of a fundamental excitation mode, said element being folded at various locations along its length in such a way to create coupling areas, whose positions along the wire and sizes, as well as coupling parameters, are determined to optimize the conditions of reception of selected harmonics of said fundamental mode.

Accordingly, the invention provides an antenna arrangement comprising a conductive element configured to resonate at or above a chosen electromagnetic radiation frequency ($F_0$), wherein the conductive element comprises one or more first parts, each first part located at, or close to, a first position (MXi) defined as a function of nodes of current of the chosen electromagnetic radiation for a given resonant mode selected amongst a fundamental resonant mode ($F_0$) and higher order resonant modes ($3F_0$, $5F_0$, $7F_0$, . . . ) of the conductive element. Said conductive element has a shape such that each of said first parts is positioned facing a second part of the conductive element located at, or close to, a second position (MXk) defined as a function of nodes of current of said electromagnetic radiation so as to create an electromagnetic coupling area modifying the resonant frequency of one of the higher order resonant modes ($3F_0$, $5F_0$, $7F_0$, . . . ).

According to various embodiments, the antenna according to the invention can comprise additional embodiments which can be considered alone or combined to each other.

Thus, according to one embodiment, the respective positions and/or lengths of said first and second parts positioned facing each other to form the coupling area, as well as the width of the gap between the two parts when the coupling area is formed, are defined to generate the predetermined shift in frequency of the selected mode.

According to another embodiment, the length l of said conductive wire element is determined by the following relation:

$$l=\lambda_0/4$$

where $\lambda_0=c/F_0$, $F_0$ being the chosen electromagnetic radiation frequency.

According to another embodiment:

the selected resonant mode is such that the wire conductive element comprises areas, each area containing a node of current (MX) of said electromagnetic radiation, for which the electromagnetic field forming the electromagnetic radiation shows a negative and a positive polarity alternately and, the first and the second parts of the conductive element face one another to create a coupling area belonging to areas of the conductive element where the electromagnetic field shows opposite polarities, providing a shift of the resonant frequency of the selected mode to a lower frequency value.

According to another embodiment:

the selected resonant mode is such that the wire conductive element comprises areas, each area containing a node of current (MX) of said electromagnetic radiation, for which the electromagnetic field forming the electromagnetic radiation shows a negative and a positive polarity alternately and, the first and the second parts of the conductive element positioned so as to face one another to create a coupling area belong to areas of the conductive element with a same polarity, providing a shift of the resonant frequency of the selected mode to a higher frequency value.

According to another embodiment, the length of the parts forming a coupling area as well as the value of the gap between said first and second parts, are determined such that they bring about the desired frequency shift for the selected harmonic mode.

According to another embodiment, the shape of the wire conductive element is configured to generate coupling only at locations where the first and second areas face one another.

According to another embodiment, the shape of the wire conductive element is configured to minimize the overall dimension of the antenna while taking the desired frequency shifts into account.

According to another embodiment, the conductive element is a wire folded in a planar structure.

According to another embodiment, the conductive element is a wire folded according to a tridimensional structure.

According to another embodiment, the conductive element is a sinuous printed track arranged on one side of a planar substrate.

The invention also provides a method for designing an antenna arrangement, comprising the steps of:

determining a length of a conductive element depending on the center frequency of a desired fundamental resonant mode;

determining center frequencies of higher order resonant modes, which need to be shifted;

defining, for each of the resonant frequencies which need to be shifted, a location and a length of a first and a second part of the conductive element fit to be coupled to provide the desired frequency shift and their relative positioning.

According to various embodiments, the method according to the invention may comprise additional embodiments which can be considered alone or combined to each other.

Thus, according to a particular embodiment, a location, a length and a relative gap of the first and second parts of the conductive element forming a coupling area are determined so as to obtain the desired shift and to minimize the undesired frequency shift induced to the resonant frequencies of some other resonant modes.

According to another embodiment, the method further comprises a step of adjusting the value of the center frequency of a resonant mode shifted as a consequence of a shift of a center frequency of another resonant mode, said correction comprising modifying an existing coupling or producing an extra coupling so as to shift the affected frequency back to its expected value.

Another object of the invention is a method for building an antenna arrangement as recited in the claims, said method comprising:

a first step of designing the antenna arrangement using the method recited in the claims;

a second step of shaping a conductive element in order to create the coupling areas defined during the first step;

a third step of arranging said shaped conductive element with a ground plane, said ground plane being located near the proximal end of the conductive element.

Advantageously, frequency shifts imparted by the coupling areas make it possible to define a set of predefined resonant frequencies for the antenna. These frequencies can be tuned to the operating frequencies of the device carrying the antenna.

Advantageously, the antenna wire element has one of a 2D or 3D compact form factor.

Advantageously too, specifications for an antenna according to the invention, for frequencies bands commonly used for "IoT" (i.e. VHF or UHF bands (30-300 MHz and 300 MHz to 3 GHz)) may be achieved with standard technologies. The antenna wire element of the invention can, for instance, conveniently be configured (folded) to radiate according to two or more frequency bands, comprising one or more bands among an ISM band, a Wi-Fi™ band, a Bluetooth™ band, a 3G band, a LTE band and a 5G band. However antennas according to the invention working at higher frequency bands may also be considered since, for higher frequencies such as those in the millimeter wave domain, state-of-the-art technologies are now available with which the invention may be implemented. For instance, semiconductor etching techniques allow the creation of ten micrometers ribbons with a precision in the micrometer range.

The multi-frequency antenna wire element of the invention may be used, either in alternate mode or in simultaneous mode on a plurality of aggregated frequencies, thus increasing significantly the bandwidth resources.

Advantageously too, due to the folding of the conductive element, the antenna of the invention may be compact, considering the lowest frequency used, which allows its integration in small packages.

Moreover, whatever the structure of the conductive element (2D or 3D wire arrangement or printed track) the antenna of the invention is simple to design, easy to connect to the printed circuit board of an electronic T/R device and easy to manufacture. It is thus of a very low manufacturing cost.

BRIEF DESCRIPTION OF THE DRAWINGS

All the features and advantages of the invention will be better understood thanks to the following detailed description of some particular embodiments, given purely by way of non-limiting examples, which refers to the appended figures which show.

In the aforementioned figures, a same functional element is referred to, as far as possible, by the same number.

DETAILED DESCRIPTION OF THE INVENTION

Figure 1:
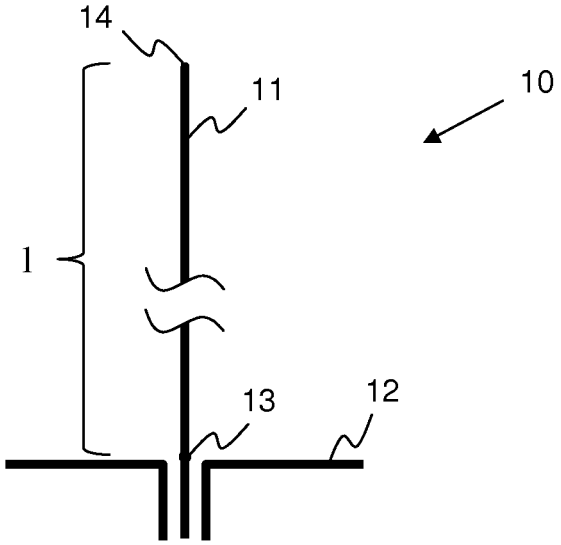
FIG. 1, a schematic illustration of a monopole antenna made of a rectilinear wire element.

FIG. 1 shows a monopole wire antenna 10 known of the prior art, made of a rectilinear conductive element 11, a metallic wire, or a conductive ribbon (conductive track) for instance.

The rectilinear conductive element 11 has a physical length l which is defined as a function of the radiating frequency of a desired fundamental resonant mode ($F_0$) of the antenna, as explained further down in the description.

The conductive element 11 is associated to a ground plane 12 located near its proximal end 13 which is adapted to be connected to a transmitter/receiver device. Such an antenna has an omnidirectional radiating pattern in the azimuth plane.

In FIG. 1, the conductive element 11 is a wire arranged to be perpendicular to said ground plane 12. The ground plane 12 may be thus a metallic plane through which the wire element 11 passes before being connected to the transmitter/receiver device, as shown on FIGS. 1 and 2 for instance.

However, in some other existing solutions, for instance when the conductive element and the ground plane are designed as a coplanar arrangement, the plane in which the conductive element 11 is arranged may be parallel to the ground plane 12, or may be inscribed in said ground plane. In such an arrangement, which is discussed below, the conductive element 11 may be a conductive track engraved on the front side of a dielectric substrate, a PCB structure as shown on FIG. 10 or 11 for instance, which comprises the transmitter/receiver circuit, whereas the ground plane 12 may be a conductive layer arranged on the back side of the substrate, i.e. the PCB.

Figure 3:
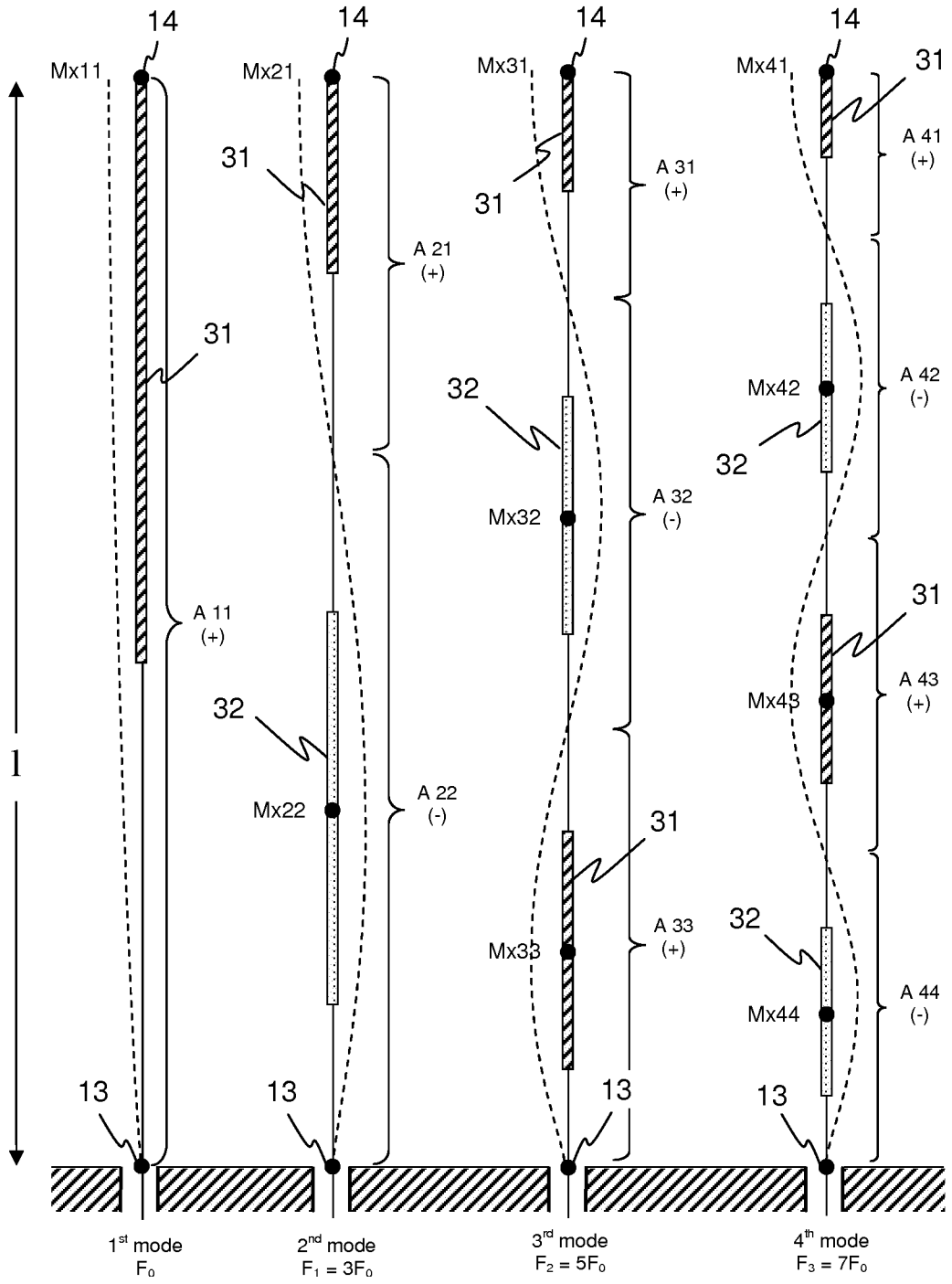
FIG. 3, an illustration of the various resonant modes adapted to be operated by the monopole antenna.

In a manner known by a person of the art, a monopole antenna is adapted to operate at different resonant modes that depend on its physical length l, mainly:

a fundamental mode ($F_0$), for which the physical length l of the radiating element is equal to $\lambda_0/4$, where $\lambda_0=c/F_0$;

a 1st higher order mode ($F_1=3F_0$), for which the physical length l of the radiating element is equal to $3\lambda_1/4$, where $\lambda_1=c/F_1$ (third harmonic);

a 2nd higher order mode ($F_2=5F_0$), for which the physical length l of the radiating element is equal to $5\lambda_2/4$, where $\lambda_2=c/F_2$ (fifth harmonic);

a 3rd higher order mode ($F_3=7F_0$), for which the physical length l of the radiating element is equal to $7\lambda_3/4$, where $\lambda_3=c/F_3$ (seventh harmonic);

FIG. 3 shows a graphic illustration of the various resonant modes according to which a monopole antenna as illustrated on FIG. 1 can operate and the respective variations of voltage along its length. It also shows the electrical characteristics of the antenna corresponding to each resonant mode. FIG. 3 makes it possible to highlight the various features of such an antenna which are used in the context of the invention.

As it can be seen on FIG. 3, when an antenna 10 is used to transmit (radiate) or receive (capture) an electromagnetic wave, the value of the voltage of the corresponding electromagnetic field is varying along the length l of the conductive element 11 as a sinusoid, the period of which depending on the order of the resonant mode. On FIG. 3, this variation is indicated by doted lines.

As shown, each of the resonant mode is thus defined by a point of maximum voltage level of the electromagnetic field (corresponding to a current node) located at the distal end 14 (or Open Circuit end) of the conductive element 11, and by a point of zero voltage (corresponding to a voltage node) of the electromagnetic field located at its proximal end 13 (or Short Circuit end), the latter corresponding to a maximum current value.

Additionally, for the various higher order modes (harmonic modes), there are other current and voltage nodes alternately distributed along the length of the conductive element 11. The number of nodes depends on the order of the mode.

For instance, for a conductive element with a length $l=\lambda_0/4$, the third resonant mode ($F_2=5F_0$ and $l=5\lambda_2/4$) shows three current nodes MX31, MX32 and MX33 whereas fundamental (first) resonant mode ($F_0$) shows only one current node MX11.

Moreover, for each resonant mode, the distance between a current node and a neighbouring voltage node is equal to $\lambda_n/4$, where n is the order of the resonant mode. For instance, for the second resonant mode (first higher mode at $F_1=3F_0$), that distance equals $\lambda_3/4$ with $\lambda_3=c/3F_0$.

As it can also be seen on FIG. 3, the polarity of the voltage induced by the electromagnetic field, relative to a common reference, varies alternately between "+" and "−" along the wire antenna element 11, such that two consecutive current nodes are located in areas of opposite polarities.

Thus, for instance, there are only one current node MX11 and one voltage node for the fundamental mode ($F_0$), which are separated from each other by the length l, whereas there are two current nodes MX21 and MX22 and two voltage nodes for the 1st higher order mode ($F_1=3F_0$) each node being separated from its neighbours by a distance equal to l/3 and three current nodes and three voltage nodes for the 2nd higher order mode ($F_2=5F_0$).

The fundamental mode ($F_0$) therefore only has one current node MX11 and a single area A11 in which the voltage of the electromagnetic field is positive ("+") and varies from a maximum value to zero whereas the first higher order mode ($F_1=3F_0$) shows two current nodes MX21 and MX22 and two areas A21 and A22 in which the voltage of the electromagnetic field is alternately positive ("+") and negative ("−") and varies between a maximum value (MX21 or MX22) and zero.

The third higher order mode ($F_2=5F_0$), in turn, has three current nodes MX31, MX32 and MX33 and three areas A31, A32 and A33 in which the voltage of the electromagnetic field is alternately positive ("+"), negative ("−") and positive ("+") again, and varies between a maximum value (MX31, MX32 or MX33) and zero.

As illustrated in FIG. 3, it is possible to determine along the conductive element 11, for each resonant frequency, particular areas where the antenna demonstrates a high electrical sensitivity, that is to say zones where the voltage of the electromagnetic field has a value still significant with respect to the maximum values MX of the nodes located in those areas.

Some of these high electrical sensitivity areas, areas 31, belong to areas where the electromagnetic field shows a given polarity and some other, areas 32, belong to areas where it shows the opposite polarity.

Figure 2:
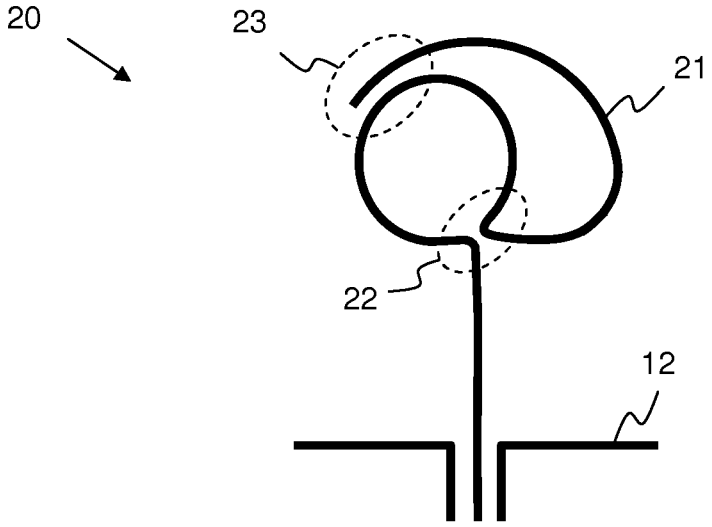
FIG. 2, a schematic illustration of the principle of the invention applied to the monopole antenna of FIG. 1.

FIG. 2 illustrates the main structural features of a monopole antenna according to the invention.

The monopole antenna 20 according to the invention is designed from a conductive rectilinear element like conductive element 11 of antenna 10 of FIG. 1.

As shown on FIG. 2, that rectilinear conductive element is folded in order to make a conductive element 21 with areas 22, 23, called coupling areas, where some parts of the conductive element (points or segments) located along its length at particular locations are positioned facing one another.

According to the invention, these parts of the conductive element 21 belong to those particular areas where the antenna shows a high electrical sensitivity. Advantageously, positioning two of these particular parts facing one another creates a coupling which induces a shift in the resonant frequency of one or more of the higher order resonant modes of the antenna. Moreover, in order to achieve an efficient coupling, the parts of the conductive element 21 which are positioned facing each other to form a given coupling area, are located at, or at least close to, points MX corresponding to current nodes for the selected resonant mode, and anyway in those areas of the conductive element with a high electrical sensitivity.

The number of the coupling areas and their location along the conductive element 21 as well as the geometrical features of each coupling area are thus determined such that each of the coupling areas is intended to produce, for a given higher order resonant mode ($3F_0$, $5F_0$, $7F_0$ . . . ), a desired shift of the resonant frequency of the conductive element 21 for that resonant mode.

The strength of the coupling between two conductive elements positioned neighboring one another is proportional to the length of the area where the conductive elements face one another and inversely proportional to the size of the gap between these two conductive elements.

As shown in FIG. 2, the parts of conductive element 21 which are positioned facing one another can either be punctual or quasi-punctual, like in coupling area 22, or form segments, like in coupling area 23.

According to the invention, considering the shift of resonant frequency the coupling area is adapted to provide, the geometrical features of each coupling area are determined based on the following properties:

The value of a frequency shift depends on the length of the corresponding coupling area: a punctual coupling area will induce a small frequency shift whereas an elongated coupling area will induce a greater frequency shift.

The value of a frequency shift also depends on the position of each of the two parts of the conductive elements in the area of high electrical sensitivity it belongs to. That means that the value of the frequency shift will be higher if the two parts of the conductive elements are located on, or close to, a point MX corresponding to a current node. However, insofar as the two parts remain located inside their respective corresponding area of high electrical sensitivity a significant frequency shift remains achievable.

The value of a frequency shift also depends on the size of the gap between the two parts of the conductive elements positioned to face each other to form the corresponding coupling area: a large gap will induce a small frequency shift whereas a small gap will induce a greater frequency shift.

The direction of a frequency shift depends on the respective polarities of the areas of the conductive element 21 the two parts forming a coupling area belong to. Indeed a coupling area formed by two parts belonging to areas of the conductive element 21 where the voltage of the electromagnetic field has opposite polarities induces a decrease of the resonant frequency, whereas a coupling area, formed by two parts belonging to areas where the voltage of the electromagnetic field has a same polarity, induces an increase of the resonant frequency. As a result, those parts must be chosen such that they form a coupling area inducing for the selected resonant mode, as desired, either a decrease or an increase of the resonant frequency.

In that context a part of the conductive element is considered located close to a given point MX if it is located inside the area of high electrical sensitivity including that point. Indeed, insofar as the two parts remain located inside their respective corresponding area of high electrical sensitivity, a significant frequency shift remains achievable.

Advantageously, forming such coupling areas, makes it possible to design a monopole antenna with a conductive element 21 of a length l to operate around various given resonant frequencies, one or more of those frequencies being different from those around which a monopole antenna made of a rectilinear conductive element 11 of a same length is normally adapted to operate, that is to say resonant frequencies that are odd multiples of a fundamental frequency $F_0$ determined by the length l of the conductive element 21 forming the antenna.

A monopole antenna according to the invention can be thus designed, for instance, from a monopole antenna with a rectilinear conductive element of a given length, configured to operate around given frequencies $F_0$, $3F_0$, $5F_0$, $7F_0$, etc . . . , by folding the conductive element to set up coupling areas along its length in order to shift some of the resonant frequencies to adapt the antenna to operate in accordance with a particular set of frequencies $F_0$, $F'_1$, $F'_2$, $F'_3$, etc. . . . used in a given application and where one or more of the frequencies $F'_1$, $F'_2$, $F'_3$, etc. . . . can differ from nominal resonant frequencies $F_1=3F_0$, $F_2=5F_0$, $F_3=7F_0$, etc . . . .

As mentioned previously, the folded antenna 20 according to the invention can be implemented in accordance with different kinds of embodiments.

Figure 4:
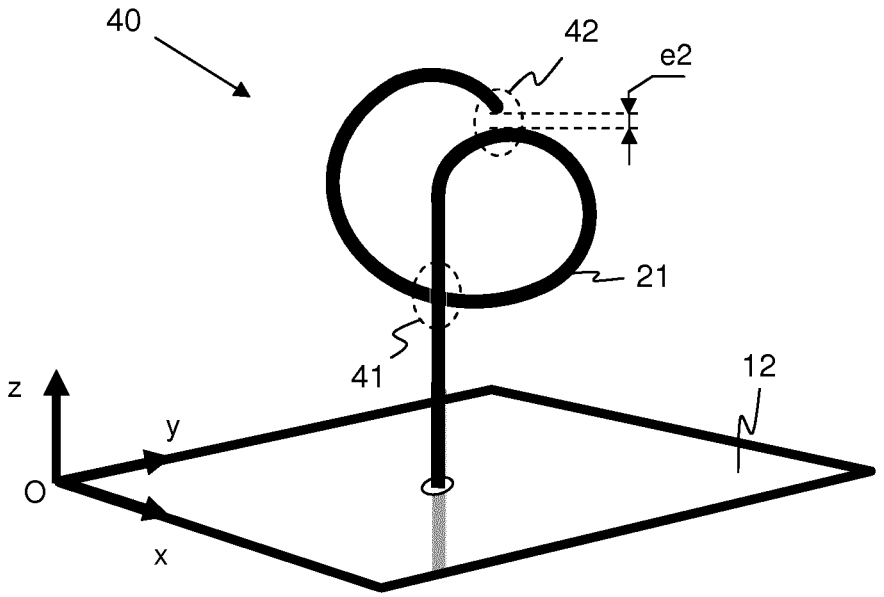
FIGS. 4 and 5, illustrations of a first exemplary embodiment of a monopole wire antenna according to the invention.
Figure 5:
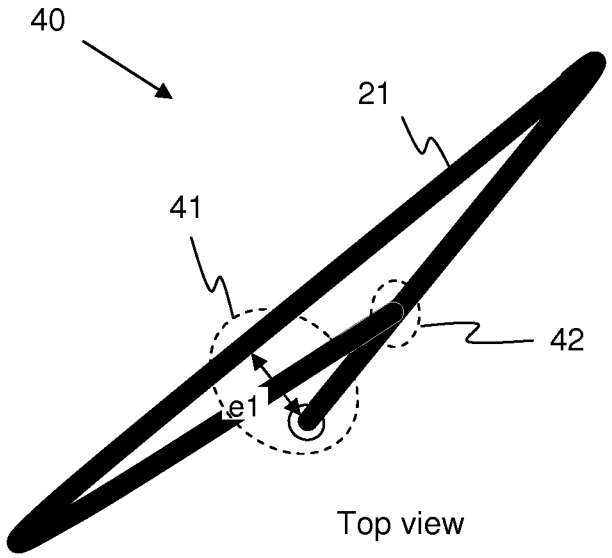

According to one series of embodiments, illustrated by examples in FIGS. 4 and 5, the antenna 20 according to the invention can be made of a conductive wire element 21 folded so as to make a substantially planar folded structure arranged perpendicularly to a ground plane 12, made of a metal plate for instance.

In such embodiments resonant frequency shifts can be obtained by fixing, for each frequency shift, the features of the corresponding coupling area, that is to say the locations, along the conductive element, of the parts of the conductive element forming the coupling area as well as their lengths and the width of the gap between these two parts. The locations of these parts are determined related to the respective polarities of the voltage at these locations.

In the exemplary embodiment of FIGS. 4 and 5, the antenna 40 has two punctual coupling areas 41 and 42, adapted to induce two resonant frequency shifts. The value of each frequency shift and the sign of the shift are given by the position of the corresponding coupling area along the conductive element 21 and by the size of the gap $e_1$ or $e_2$ located between the two parts of the conductive element that are positioned facing each other.

Figure 6:
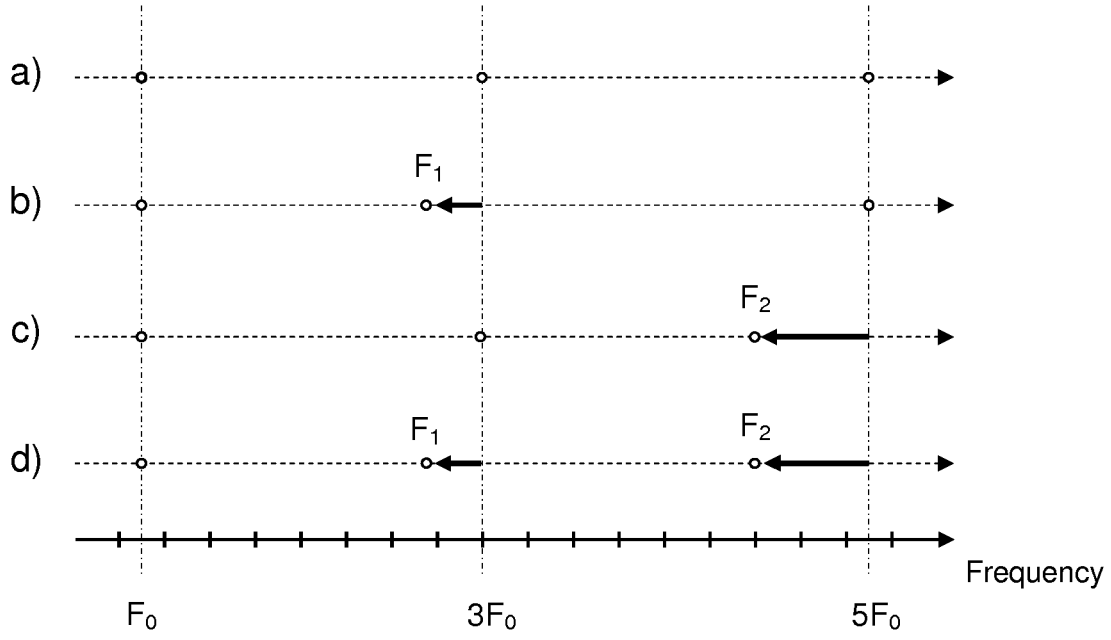
FIG. 6, a graphic illustration of the effect of the physical features of coupling areas arranged on the conductive element of a monopole antenna, on the shift of the resonance frequencies of the considered antenna.

FIG. 6 illustrates graphically the various results that can be obtained with an antenna like the exemplary antenna of FIGS. 4 and 5 considering that the coupling areas 41 and 42 are arranged so as to shift resonant frequencies of the second and the third resonant modes to frequencies $F_1$ and $F_2$ respectively lower than $3F_0$ and $5F_0$. FIG. 6 illustrates four different configurations of coupling respectively referenced a), b), c) and d).

The frequency shifts illustrated on FIG. 6 may for instance be obtained by positioning point MX33 or a point close to MX33 of element 21 facing point MX32 or a point close to MX32 to form coupling area 41, and terminal point MX21 or a point close to MX21 facing point MX22 or a point close to MX22 to form coupling area 42.

Points MX33 and MX32 belonging to areas 31 and 32 of the conductive element 21 for which the electromagnetic field has opposite polarities, the frequency shift caused by coupling area 41 results in a decrease of the resonant frequency $F_2$ with respect to initial resonant frequency $5F_0$.

Similarly, MX21 and MX22 belong to areas 31 and 32 of the conductive element. As a result, the frequency shift caused by coupling area 42 results in a decrease of the resonant frequency $F_1$ with respect to initial resonant frequency $3F_0$.

Configuration a) corresponds to a case where the values $e_1$ and $e_2$ of the gaps between the parts of the conductive element 21 forming the coupling areas 41 and 42 are such that no significant coupling appears in any of the two areas. Thus, none of the resonant frequencies $3F_0$ and $5F_0$ is shifted.

Configuration b) corresponds to a case where the value $e_1$ of the gap between the parts of the conductive element 21 forming the coupling area 41 is wide enough not to induce a significant coupling in that area. As a result resonant frequency $5F_0$ is advantageously not shifted.

In contrast the value $e_2$ of the gap between the parts of the conductive element 21 forming the coupling area 42 is small enough to induce a coupling in that area. As a result, resonant frequency $3F_0$ is shifted to a resonant frequency $F_1$ lower than $3F_0$.

Configuration c) corresponds to a case similar to configuration b) but where the value $e_1$ of the gap between the parts of the conductive element 21 forming the coupling area 41 is such that a coupling appears in that area, whereas the value $e_2$ of the gap between the parts of the conductive element 21 forming the coupling area 42 is such that no significant coupling appears in that area. As an interesting result, resonant frequency $3F_0$ is not shifted and frequency $5F_0$ is shifted to a resonant frequency $F_2$ lower than $5F_0$.

Configuration d) corresponds to a case where both values $e_1$ and $e_2$ of the gaps between the parts of the conductive element 21 forming the coupling areas 41 and 42 are such that a coupling appears in the two areas. This advantageously leads to the resonant frequency $3F_0$ being shifted to a resonant frequency $F_1$ lower than $3F_0$ and frequency $5F_0$ shifted to a resonant frequency $F_2$ lower than $5F_0$.

Figure 7:
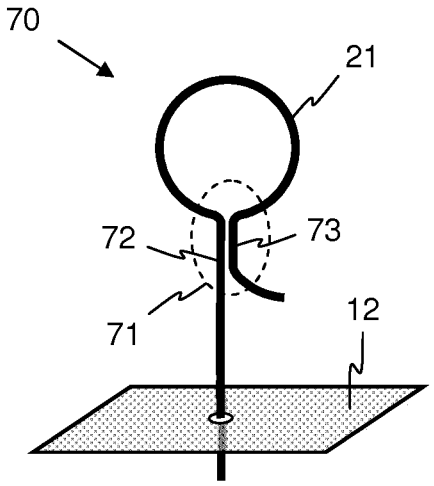
FIGS. 7 to 9, illustrations of various exemplary embodiments of monopole wire antennas shaped in accordance with the invention.
Figure 8:
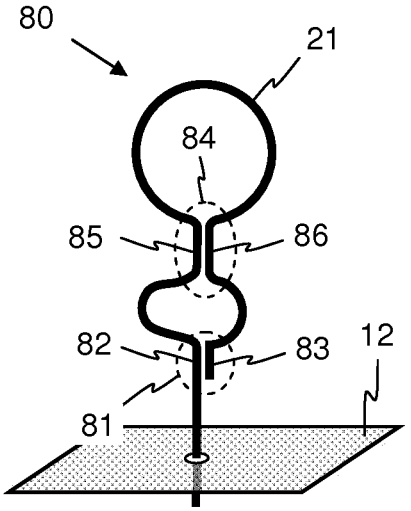

FIGS. 7 and 8 illustrate two other exemplary embodiments 70 and 80 of the antenna according to the invention, wherein the antenna comprises a conductive wire element 21, arranged in a full planar configuration and folded in a plane. Antenna 70 of FIG. 7 comprises one coupling area 71 made of two parts 72, 73 of the conductive element 21 positioned facing each other. The location and the length of the two parts 72 and 73 as well as the gap between them are determined so as to obtain the desired shift of the resonant frequency (3F0, 5F0, . . . ) of one given resonant mode. Antenna 70 is thus conformed to produce a single desired frequency shift. Antenna 80 of FIG. 8 comprises two coupling areas: one coupling area 81 made of two parts 82 and 83 of the conductive element 21 and another coupling area 84 made of two other parts 85 and 86, of the same conductive element 21. The location and the length of the two parts forming a given coupling area 81 or 84, as well as the gap between the parts forming the latter are determined so as to obtain the desired shift of the resonant frequency of one given resonant mode. Antenna 80 is thus conformed to produce two desired frequency shifts.

Figure 9:
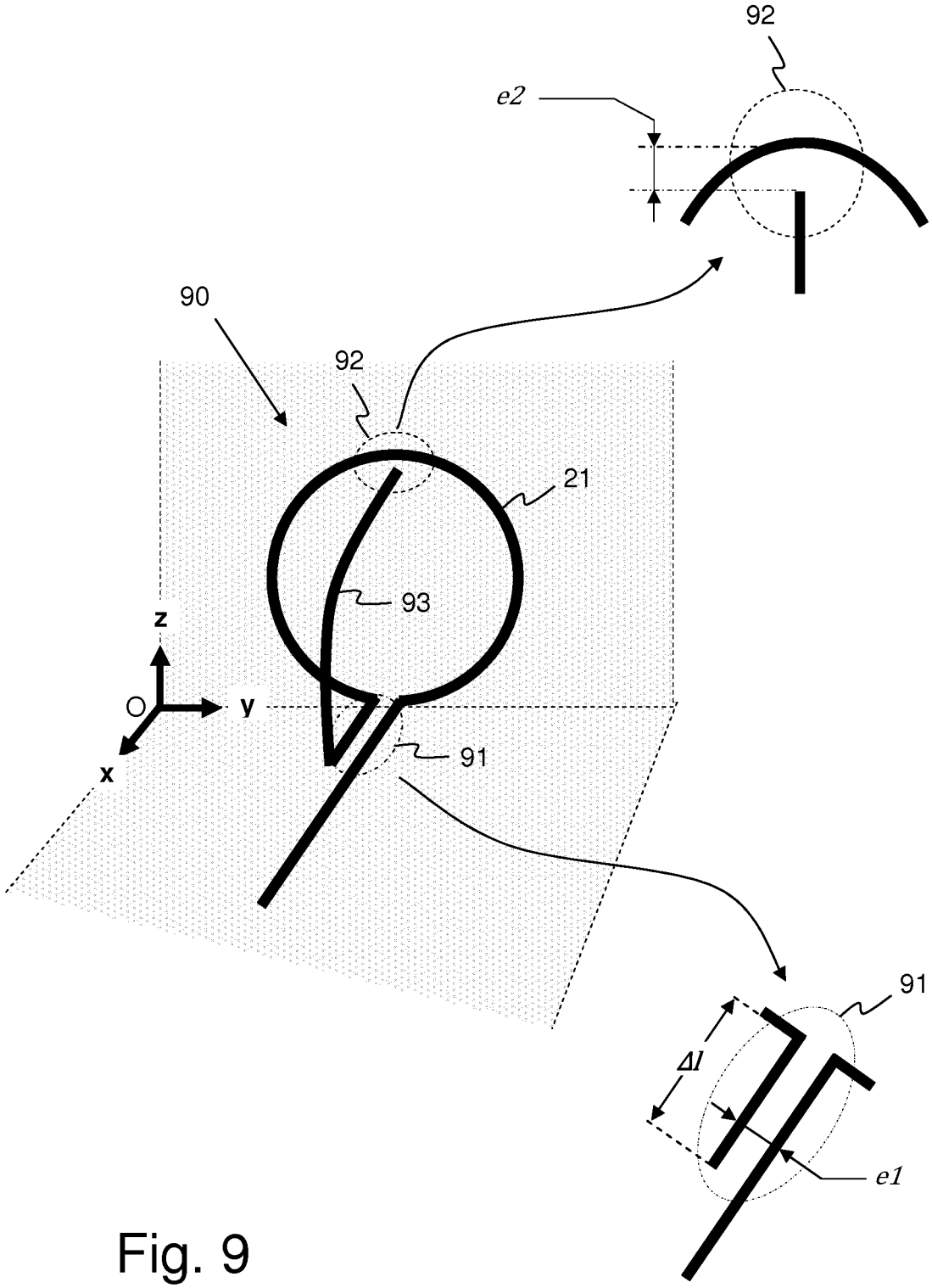

FIG. 9 illustrates another exemplary embodiment of the antenna according to the invention, wherein the antenna 90 comprises a conductive wire element 21, arranged spatially in relation to three perpendicular planes: planes xOy and yOz, and a plane parallel to plane xOz comprising the distal portion 93 of the conductive element 21 linking the two coupling areas 91 and 92. This embodiment, quite similar to the embodiment of FIGS. 4 and 5 advantageously provides more possibilities, more degrees of freedom, to form various coupling areas along the conductive element 21, either punctual coupling areas like area 92, made of two points distant from one another of a gap e2, or elongated coupling areas, like area 91 made of two parts with a length Δl, remote from each other from a gap e1.

Figure 10:
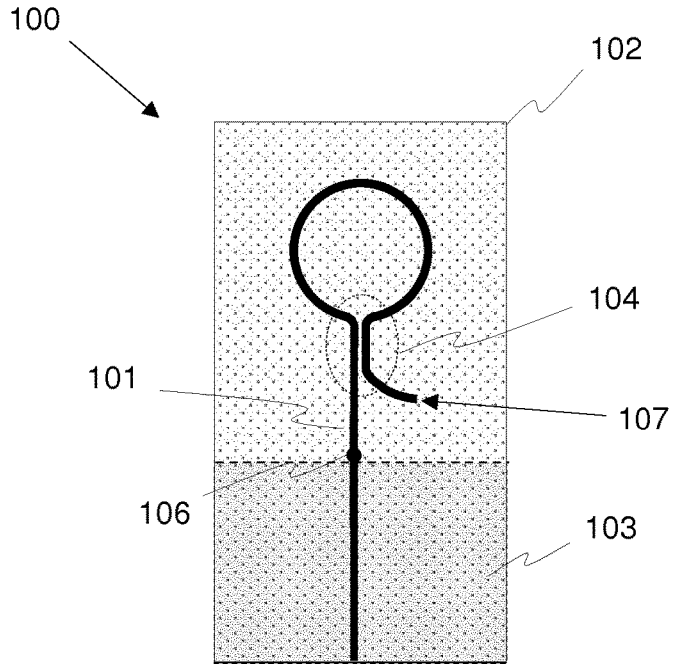
FIGS. 10 to 12, illustrations of various exemplary embodiments of monopole antennas based on a printed circuit technology.
Figure 11:
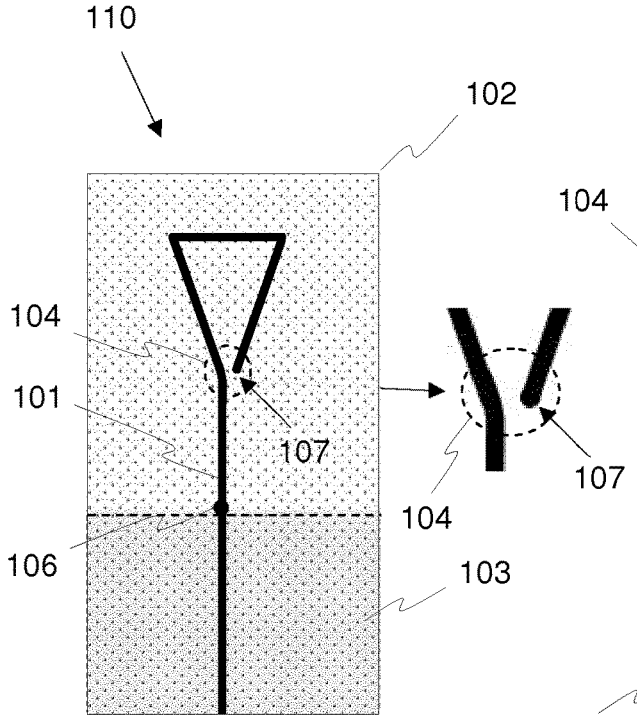
Figure 12:
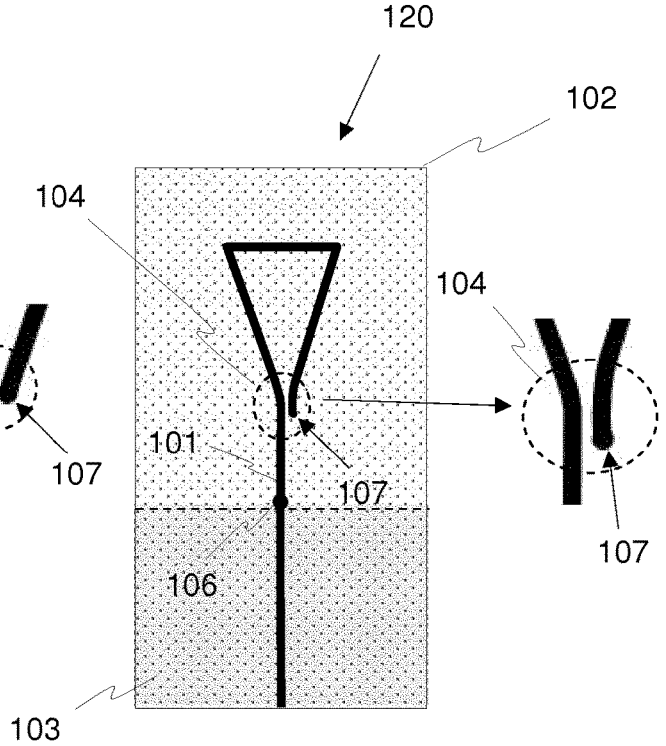

According to another series of embodiments, illustrated by FIGS. 10 to 12, the antenna 100, 110 or 120 according to the invention can be made of a sinuous conductive track 101 arranged on one side of a plane substrate 102, the opposite side being partly covered by a conductive layer forming a ground plane area 103 located facing the end of the conductive track configured to be connected to a transmitter/receiver device.

According to this kind of embodiments, the coupling areas 104 are thus created by shaping the conductive track 101 in such a way that some parts of the track are arranged to face other parts. The overall length of the track, i.e. the part of the track extending from signal feed point 106 and the distal end 107 of the track, determines the resonant frequency of the fundamental resonant mode.

Insofar as the ground plane and the conductive element of such antennas are arranged in parallel plans formed by the two opposite sides of a same planar substrate—instead of being arranged in perpendicular plans like in embodiments comprising wire-made conductive elements—this kind of embodiment is well suited to applications embodied in relatively small or thin packages small communication devices such as smartphone or the like. However, like antennas made of a wire conductive element folded according to a plane, antennas of FIGS. 7 and 8 for instance, the number of coupling areas that can be formed at the same time is limited by the planar bidimentional '2-D" structure of the conductive track 101. As a result, the number of resonant frequencies that can be shifted at the same time, each with the desired increase or decrease, is also more limited in this configuration.

Figure 13:
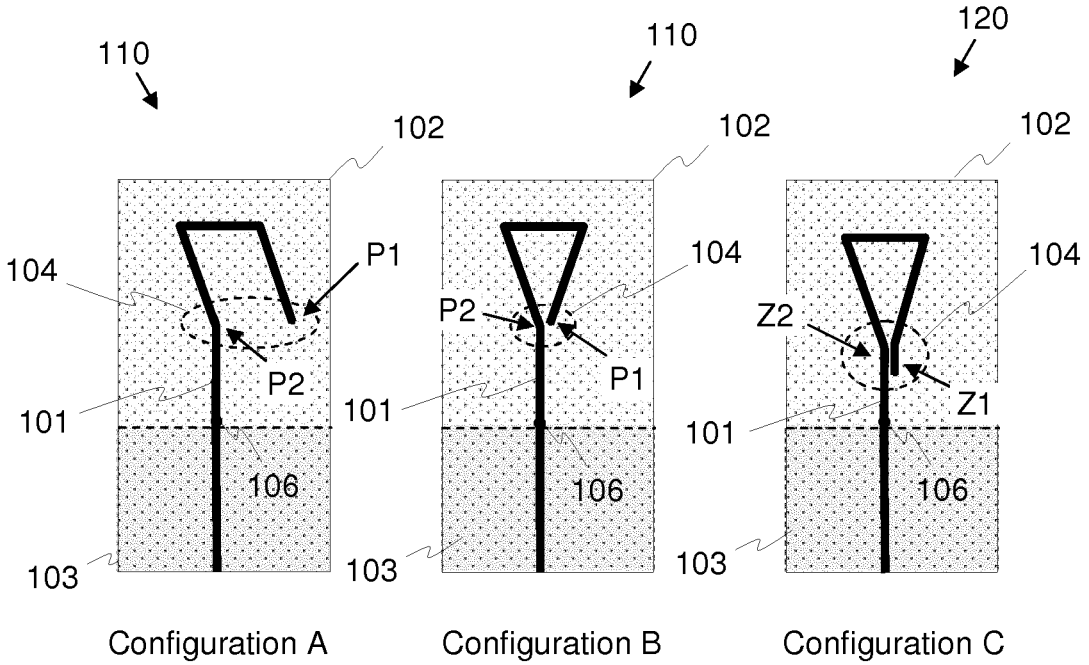
FIG. 13, a diagram showing the frequency behavior of printed circuit monopole antennas like those of FIGS. 11 and 12 in different configurations of coupling.
Figure 13:
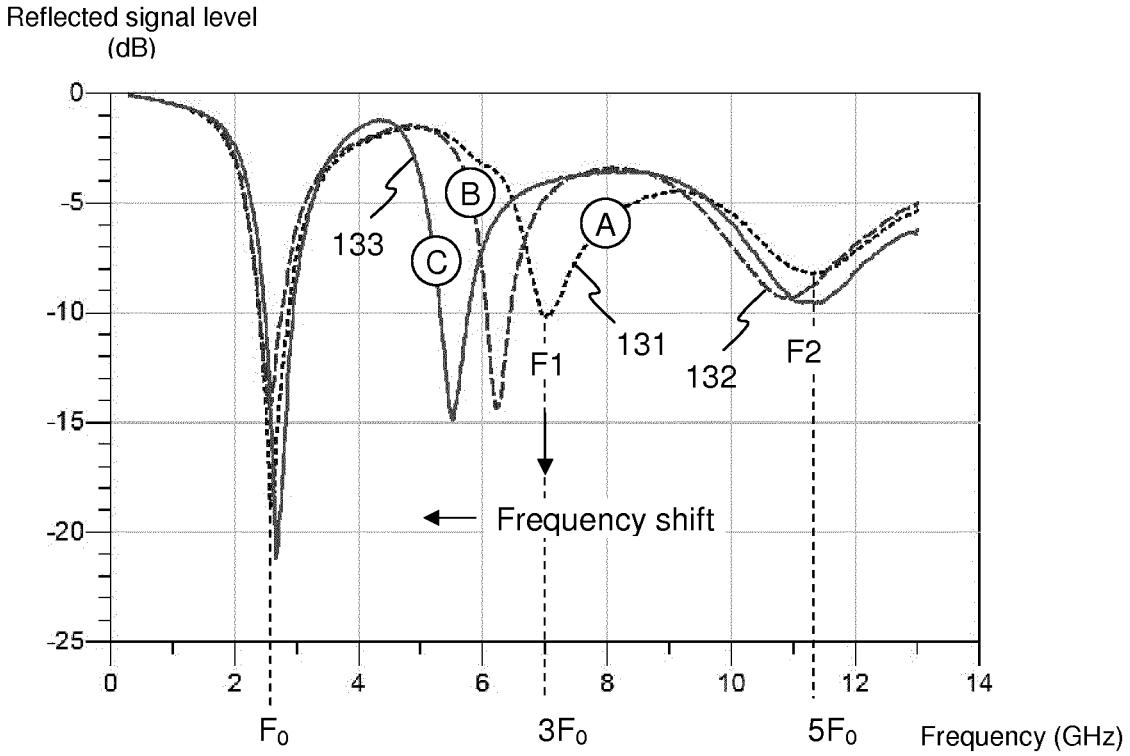

FIG. 13 represents the particular case of an antenna 110 according to FIG. 11, wherein the antenna comprises a single punctual coupling area formed by points P1 and P2, and the particular case of an antenna 120 according to FIG. 12, wherein the antenna comprises a single elongated coupling area formed by segments Z1 and Z2 of the conductive track 101. It represents the variation of the frequency response of an antenna according to the invention induced by a coupling area 104.

FIG. 13 shows three curves 131, 132 and 133, each of them representing the frequency response of the antenna in one of the three configurations A), B) and C) shown above the curves.

For configuration A), with a wide gap between the two points P1 and P2 forming coupling area 104, the frequency response doesn't display any shift of the resonant frequencies $F_0$, $3F_0$ and $5F_0$, meaning that the coupling 104 is too weak to induce any shift.

Regarding configuration B), with a much narrower gap between the two points P1 and P2, frequency response displays a decrease of the resonant frequency $F_1=3F_0$ that shifts to a desired frequency $F'_1$, whereas resonant frequencies $F_0$, and $F_2=5F_0$ remain substantially unshifted. This means that, due to the low value of the gap between points P1 and P2, the coupling 104 induces a shift of resonant frequency $F_1=3F_0$ of the first higher resonant mode. This also means that points P1 and P2 are located on parts of the conductive track 101 where the voltage of the electromagnetic field has opposite polarities, parts respectively belonging to areas 31 and 32 shown on FIG. 3.

Regarding configuration C), with the same gap between the two segments Z1 and Z2 as between points P1 and P2, frequency response displays a decrease of the resonant frequency $F_1=3F_0$ that shifts to frequency $F'_1$ ($F'_1<F_1$) whereas resonant frequencies $F_0$, and $F_2=5F_0$ remain substantially unshifted. This means that, due to the low value of the gap between segments Z1 and Z2, respectively including P1 and P2, the coupling 104 induces a shift of resonant frequency $F_1=3F_0$ of the first higher resonant mode. This also means that, due to the extent of the coupling zone, the strength of the coupling in configuration C) is higher than that of the coupling in configuration B) for a same gap value, inducing a more important frequency shift. Illustration of FIG. 13 considers the particular case of an antenna according to the invention comprising a single coupling area, inducing a single frequency shift to show the influence of the geometrical features of a coupling area on the value of the resonant frequency shift.

However, it is obvious for an ordinarily skilled person that, when the antenna comprises several coupling areas, the same applies to each corresponding frequency shift.

As described in the previous paragraphs, an antenna according to the invention can advantageously optionally be built from a known monopole antenna, with a rectilinear $\lambda_0/4$ conductive element, by folding said conductive element in order to create coupling areas, said coupling areas inducing desired frequency shifts on resonant frequencies of the conductive element.

According to the invention, a coupling area is created by positioning two parts of the conductive element facing each other. The coupling areas are defined by the strength of the coupling provided and by the polarity of the areas of the conductive element the two parts of the conductive element belong to. The size of the gap between the two parts of the conductive element involved in the coupling area and the lengths of these two parts, determine the strength of the coupling, and thus the value of the frequency shift, whereas the sign of the shift (increase or decrease) is determined by the polarity of the areas of the conductive element the two segments belong to.

An antenna according to the invention can therefore be designed, considering those parameters, by implementing a design method comprising the following steps.

A first step consists in determining the length of the conductive element, in accordance with the lower operating frequency of the set of frequencies ($F'_0$, $F'_1$ . . . , $F'_N$) on which the designed antenna is expected to work.

In most cases, the length of the conductive element will be determined such that the frequency $F_0$ of the fundamental resonant mode of the conductive element, which cannot be shifted, will correspond to the lower operating frequency $F'_0$, in order to operate the antenna in the most efficient manner and to simplify the design. Nevertheless, the length of the conductive element may, in some cases, be determined such that frequency F0 corresponds to another frequency, another frequency of the set of working frequencies for instance.

Indeed, as it can be noticed considering the present disclosure, and considering in particular FIG. 3, the frequency $F_0$ of the fundamental resonant mode cannot be shifted, since for that resonant mode the length of the conductive element corresponds to the quarter of the fundamental wavelength $\lambda_0$. That means that, for that mode, the voltage of the electromagnetic field has only one maximum MX11 and only one area of high electrical sensitivity. As a consequence, no coupling area can be created to induce any frequency shift.

As a result, $F'_0$ being determined, the length l of the conductive element may then be defined in such a way that the fundamental resonant mode appears for a frequency $F_0$ corresponding substantially to the lower frequency $F'_0$ of the set of expected frequencies ($F'_0$, $F'_1$ . . . , $F'_N$). Moreover, since the length l of the conductive element is determined, both frequency $F_0$ and the resonant frequencies ($F_1=3F_0$, $F_2=5F_0$, $F_3=7F_0$, etc. . . . ) of the higher resonant modes are also determined.

A second step consists in selecting the resonant frequency or frequencies of those of the higher order modes which are to be shifted to obtain the other desired frequency values $F'_1$, $F'_2$, $F'_3$, etc. . . . and to determine the value of the corresponding frequency shifts as well as the sign of these shifts (increase or decrease). The values of these shifts are directly deduced from the resonant frequencies obtained with a conductive element of the length determined at the previous step.

A third step consists in determining, for each frequency shift determined at the previous step, the features of the coupling area fit to achieve that shift, said features being:

the locations of the two parts of the conductive element to be positioned facing each other: locations such that the two parts belong to areas where the voltage of the electromagnetic field has a same polarity or locations where the voltage of the electromagnetic field has opposite polarities;

the lengths of these parts; and the width of the gap between these two parts at the location of the coupling area.

The third step must be implemented for each resonant frequency to be shifted, considering the other coupling areas to create and the effect of the setting up of a given coupling area on potential unwanted shifts that may affect other resonant frequencies.

Indeed, as it can be noticed considering FIG. 3, setting up a coupling area to shift a given resonant frequency is achieved by positioning facing one another two points of maximum voltage of the electromagnetic field located in two different areas of high electrical sensitivity, or two segments of the conductive element containing these points or located close to them. This may result in said coupling area thus created to shift other resonant frequencies at the same time, causing unwanted shifts.

Each coupling area has to be therefore designed in order to prevent, as far as possible, any unwanted frequency shift. However, if the design of a given coupling area that is adapted to induce the necessary shift of a given resonant frequency seems to induce an unwanted shift on another resonant frequency, such unwanted shift can often be cancelled by designing an additional coupling area fit to produce an opposite shift or by modifying the features of another coupling area, already fit to cause a given shift to the resonant frequency that was unwillingly modified.

Thus, implementation of the design method described here above makes it advantageously possible to design an antenna according to the invention fit to operate at a number of resonant frequencies different from those of a monopole antenna of the prior art. As a result, the method to create an antenna according to the invention comprises two steps:

a first step of designing the antenna that implements the design method according to the invention disclosed above;

a second step of creating the antenna using a conductive element that is folded to create the designed coupling areas defined during the first step.

As described previously, the antenna arrangement according to the invention comprises a conductive element 21 configured to resonate at and above a chosen electromagnetic radiation frequency ($F_0$) corresponding to a fundamental resonant mode.

According to the invention, the conductive element 21 is folded to achieve coupling areas 22 and 23 intended to modify one or more of the resonant frequencies ($3F_0$, $5F_0$, $7F_0$ . . . ) of the higher resonant modes of the conductive element 21.

Such coupling area is formed by positioning given parts of the conductive element 21 facing each other in accordance with a given relative position.

The location of these parts along the conductive element 21, as well as the length of these parts and as the width of the gap between them are determined so as to obtain a given strength of coupling providing a desired increase or decrease of the resonant frequency of a given resonant mode of the conductive element 21.

The field of the present invention is not limited to VHF and UHF frequencies Bands, but can rather cover higher frequency bands corresponding to millimeter waves, like WiFi™ 802.11 ad Band (57-64 GHz) or 5G bands (24.25 GHz, 27.5 GHz, 31.8-33.4 GHz, 37-43.5 GHz, 45.5-50.2 GHz, 50.4-52.6 GHz, 66-76-GHz and 81-86 GHz for instance), or else like WBAN (Wireless Body Area Network) band (60 GHz). The principle of design of antennas according to the invention operating at these frequencies remains the same. Only the precision of the manufacturing means necessary to produce such antennas is increased due to the small size of those antennas.

The examples disclosed in this specification are only illustrative of some embodiments of the invention that may be combined when appropriate. They do not in any way limit the scope of said invention, which is defined by the appended claims.

The invention claimed is:

1. An antenna arrangement comprising a conductive element of length l, configured to resonate at or above a chosen electromagnetic radiation frequency ($F_0$), wherein the conductive element comprises a first part comprising a first node of current of the chosen electromagnetic radiation frequency for a given resonant mode selected amongst a fundamental resonant mode ($F_0$) and higher order resonant modes ($3F^0$, $5F_0$, $7F_0$, . . . ) of the conductive element, wherein said first part is positioned facing a second part of the conductive element comprising a second node of current of said chosen electromagnetic radiation frequency so as to create an electromagnetic coupling area configured to shift the resonant mode of one of the higher order resonant modes ($3F_0$, $5F_0$, $7F_0$, . . . ).

2. The antenna arrangement of claim 1, wherein respective positions and/or lengths of said first and second parts positioned facing each other to form the coupling area, as well as a width of a gap between said first and second parts, are configured to generate a predetermined shift in frequency of a selected higher order resonant mode.

3. The antenna arrangement of claim 1, wherein the length l of said conductive wire element is determined by the following relation:

$$l=\lambda_0/4$$

where $\lambda_0=c/F_0$, $F_0$ being the chosen electromagnetic radiation frequency.

4. The antenna arrangement of claim 1, further configured to provide a shift of the resonant mode of a selected higher order resonant mode to a lower frequency value, wherein:

the selected resonant mode is such that the wire conductive element comprises areas, each area containing a node of current (MX) of said electromagnetic radiation, for which the electromagnetic field forming the electromagnetic radiation shows a negative and a positive polarity alternately and, the first and the second parts of the conductive element positioned facing one another to create a coupling area belong to areas of the conductive element with opposite polarities.

5. The antenna arrangement of claim 1, further configured to provide a shift of the resonant mode of a selected higher order resonant mode to a higher frequency value, wherein:

the selected resonant mode is such that the wire conductive element comprises areas, each area containing a node of current (MX) of said electromagnetic radiation, for which the electromagnetic field forming the electromagnetic radiation shows a negative and a positive polarity alternately and, the first and the second parts of the conductive element positioned facing one another to create a coupling area belong to areas of the conductive element with a same polarity.

6. The antenna arrangement according to claim 1, wherein the length of the parts forming a coupling area as well as a value of a gap between said first and second part, are determined to produce a desired frequency shift for a selected harmonic mode.

7. The antenna arrangement according to claim 1, wherein the conductive element is a wire conductive element and is configured to produce a coupling only at the locations where the first and second areas face one another.

8. The antenna arrangement according to claim 1, wherein, taking desired frequency shifts into account, the conductive element is shaped to minimize the overall dimension of the antenna.

9. The antenna arrangement according to claim 1, wherein the conductive element is a wire folded according to a planar structure.

10. The antenna arrangement according to claim 1, wherein the conductive element is a wire folded according to a tridimensional structure.

11. The antenna arrangement according to claim 1, wherein the conductive element is a sinuous conductive track arranged on one side of a planar substrate.

12. A method for designing an antenna arrangement, the method comprising:

determining a length l of a conductive element depending on a center frequency of a desired fundamental resonant mode, wherein the conductive element comprising a first part comprising a first node of current of a chosen electromagnetic radiation for a given resonant mode selected amongst a fundamental resonant mode ($F_0$) and a higher order resonant mode ($3F_0$, $5F_0$, $7F_0$, . . . ) of the conductive element, wherein the conductive element comprising a second part comprising a second node of current of said electromagnetic radiation for the given resonant mode;

determining center frequencies of higher order resonant modes, which need to be shifted;

defining, for each of the center frequencies which need to be shifted, a location and a length of the first and the second part to be coupled to provide a desired frequency shift and a relative positioning of the first and second parts; and positioning said first part facing said second part so as to create an electromagnetic coupling area configured to shift a center frequency of one of the higher order resonant modes ($3F_0$, $5F_0$, $7F_0$, . . . ).

13. The method according to claim 12, wherein the location, the length and a relative gap of the first and second parts of the conductive element forming the electromagnetic coupling area are determined to obtain a desired shift and to minimize an undesired frequency shift induced to the center frequencies of some other resonant modes.

14. The method according to claim 12, further comprising adjusting a value of a center frequency of a resonant mode affected by a shift of a center frequency of another resonant mode, said adjusting comprising modifying a shape of the conductive element to modify an existing coupling or produce an extra coupling in order to shift the affected frequency to a desired value.

15. A method for building the antenna arrangement according to claim 1, said method comprising:

a first step of designing the antenna arrangement, the designing comprising:

determining the length l of the conductive element depending on a center frequency of a desired fundamental resonant mode;

determining center frequencies of higher order resonant modes, which need to be shifted; and defining, for each of the center frequencies which need to be shifted, a location and a length of the first and the second part of the conductive element to be coupled to provide a desired frequency shift and a relative positioning of the first and second parts;

a second step of shaping the conductive element to create coupling areas defined during the first step; and a third step of arranging said shaped conductive element with a ground plane, said ground plane being located near a proximal end of the conductive element.

* * * * *